United States Patent [19]

Struckman

[11] Patent Number: 4,594,595

[45] Date of Patent: Jun. 10, 1986

[54] CIRCULAR LOG-PERIODIC DIRECTION-FINDER ARRAY

[75] Inventor: Keith A. Struckman, Hollis, N.H.

[73] Assignee: Sanders Associates, Inc., Nashua, N.H.

[21] Appl. No.: 601,420

[22] Filed: Apr. 18, 1984

[51] Int. Cl.[4] ..... H01Q 11/10

[52] U.S. Cl. ..... 343/770; 343/792.5

[58] Field of Search ..... 343/792.5, 767–770, 343/731, 737, 738, 739, 789, 846

[56] References Cited

U.S. PATENT DOCUMENTS

| | | | |
|---|---|---|---|
| 2,981,949 | 4/1961 | Elliott | 343/771 |
| 3,218,644 | 11/1965 | Berry | 343/770 |
| 3,369,243 | 2/1968 | Greiser | 343/792.5 |
| 3,530,478 | 9/1970 | Corzine et al. | 343/771 |
| 3,633,207 | 1/1972 | Ingerson et al. | 343/770 |
| 4,360,816 | 7/1971 | Corzine | 343/792.5 |

*Primary Examiner*—Eli Lieberman
*Assistant Examiner*—Michael C. Wimer
*Attorney, Agent, or Firm*—Louis Etlinger; David J. Thibodeau, Jr.

[57] ABSTRACT

A circular frequency-independent antenna array (10) includes a plurality of radially extending log-periodic subarrays (12, 14, 16, 18, 20, and 22) of slot radiators (26) provided in a ground-plane conductor (28). Associated with each slot is a cavity (34) into which the slot opens. A traveling-wave element in the form of a wire (30) cooperates with a ground-plane conductor (28) in which the slots are provided to support propagation of an electromagnetic signal. The signal is radiated upon encountering a slot that resonates at a frequency near that of the signal, and the depths of the cavities are adjusted so that the phase relationships between the radiation from the slots and the signal propagated along the traveling-wave element results in an antenna pattern that launches radiation in a direction away from the center of the array. Direction-finding errors are reduced because interference between the several subarrays is kept to a minimum.

8 Claims, 4 Drawing Figures

CIRCULAR LOG-PERIODIC DIRECTION-FINDER ARRAY

BACKGROUND OF THE INVENTION

The present invention is directed to antennas. It is particularly advantageous in direction-finding antennas, although it can be applied to other types of antennas as well.

It is often required of direction-finder antenna systems that they be capable of covering the entire 360° azimuthal range at and a little above the elevation of the horizon. In the past, most devices for achieving this purpose have been limited to a very narrow bandwidth. Consequently, when devices of this type were employed, a large number of them were needed if the frequency band to be monitored was wide.

An antenna whose characteristics are relatively frequency independent throughout a broad bandwidth is the log-periodic antenna. In such an antenna, the individual radiating elements are disposed along and perpendicular to an axis. The dimensions of the individual elements are proportional to the distance of the element from a reference point, or vertex, on the axis, and the distances between adjacent elements along the axis are also proportional to the distance from the vertex so that the ratio of the dimensions of one element to those of the previous adjacent element in the array is the same as the ratio for any two other adjacent elements.

Although this log-periodic structure results in a relatively frequency-independent response, radially orienting a number of such structures as subarrays of a composite array to achieve a 360° range has not in the past proved satisfactory. The interaction between the individual log-periodic subarrays has resulted in direction-finding errors. Thus, it was previously necessary to employ either a narrow-band device to achieve the 360° range, to use extensive azimuth, elevation, and polarization antenna-response calibrations, or to limit the log-periodic structure to a single log-periodic array and thereby achieve the frequency-independent response without the 360° coverage in a single device.

SUMMARY OF THE INVENTION

I have found a way largely to eliminate the direction-finding errors that can result from interference among log-periodic subarrays in an antenna array in which the log-periodic subarrays extend like spokes from a common central region. I arrange the log-periodic subarrays so that they radiate in a forward-wave mode—i.e., in a direction generally away from the central region. Specifically, I provide each log-periodic subarray as a log-periodic sequence of slots in a ground plane, with a traveling-wave element extending along one side of the ground plane and cavities associated with the respective slots disposed on the other side of the ground plane. The depths of the cavities bear the same relationships to each other as do the dimensions of their respective slots. The relationship of the depths of the cavities to the dimensions of their respective slots affects the pattern resulting from the subarray, and I provide the cavities with depths that result in an antenna pattern in which the sensitivity to electromagnetic radiation received from the direction of the inner end of the subarray—i.e., from the direction of the central region of the array—is much lower than its sensitivity to radiation received from the direction of the outer end. In this way, interference between subarrays of the antenna array, and thus direction-finding errors, are minimized.

BRIEF DESCRIPTION OF THE DRAWINGS

These and further features and advantages of the present invention are described in connection with the accompanying drawings, in which.

DETAILED DESCRIPTION OF THE PREFERRED EMBODIMENT

Figure 1:
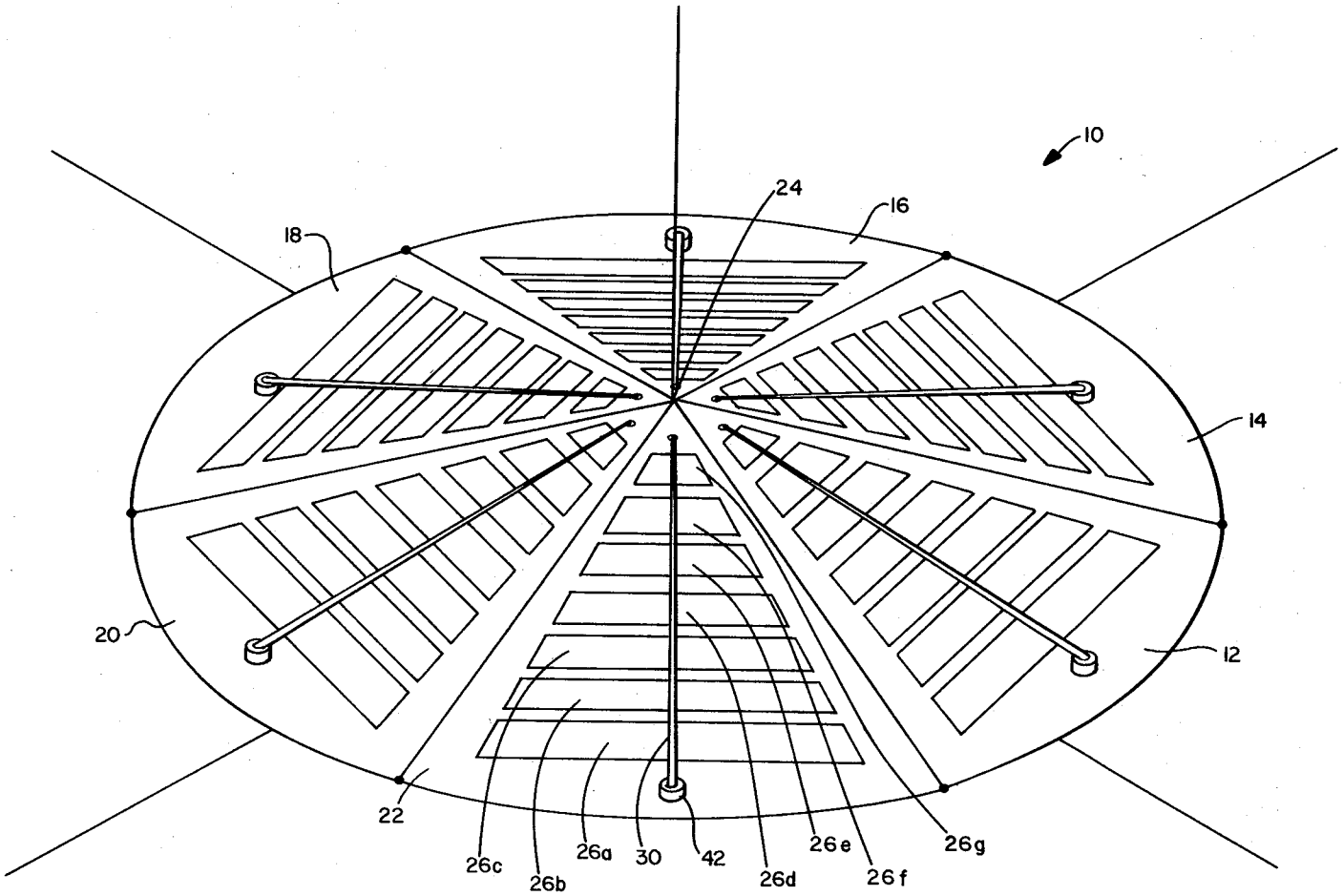
FIG. 1 is a perspective view of the circular antenna array of the present invention.
Figure 3:
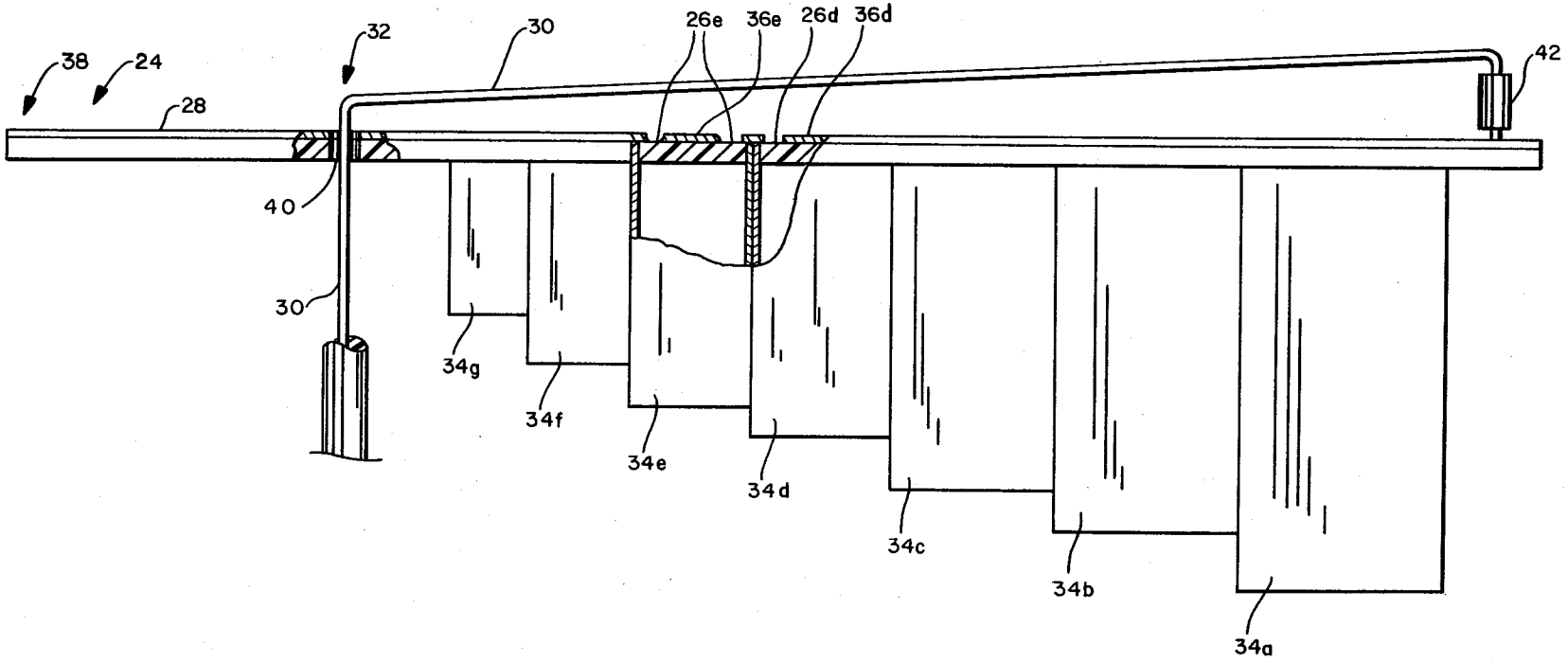
FIG. 3 is a perspective view of a single log-periodic subarray showing the cavities associated with the slots in the subarray.

FIG. 1 depicts a circular log-periodic direction-finder antenna array 10 including six log-periodic subarrays 12, 14, 16, 18, 20, and 22 extending radially from the central portion 24 of the array. Each of the subarrays is similar to subarray 22, which has seven slots 26*a–g* in a ground plane 28. The ground planes are tilted slightly from a coplanar orientation so that together they form a generally conical shape. As FIG. 3 shows, a wire 30 extends longitudinally along the subarray. It acts as a traveling-wave element to cooperate with the ground plane 28 in propagating the received signal toward its inner end 32 where its signal is combined (either at RF or digitally) in desired phase and amplitude relationships with signals from the other subarrays in one or more receivers not shown in the drawings.

The slots 26*a–g* open into cavities 34*a–g*. According to the present invention, the depths of the cavities 34*a*–34*g* are selected to ensure that the subarray 22 is much more sensitive to radiation received from the right in FIG. 3 than to radiation received from the left.

The antenna 10 can be used for omnidirectional reception by adding together the signals from all of the subarrays with equal delays. More typically, the signals from the several subarrays are combined either at RF or digitally with relative delays chosen in accordance with known principles to favor particular directions and thereby determine the direction of a signal source.

For the remainder of the description, the antenna will be described most often as though it were employed for transmission rather than reception. The reason for the description in terms of transmission is that such a description is considerably more straightforward, and the reciprocity theorem states that the antenna patterns for transmission are the same as those for reception.

Figure 2:
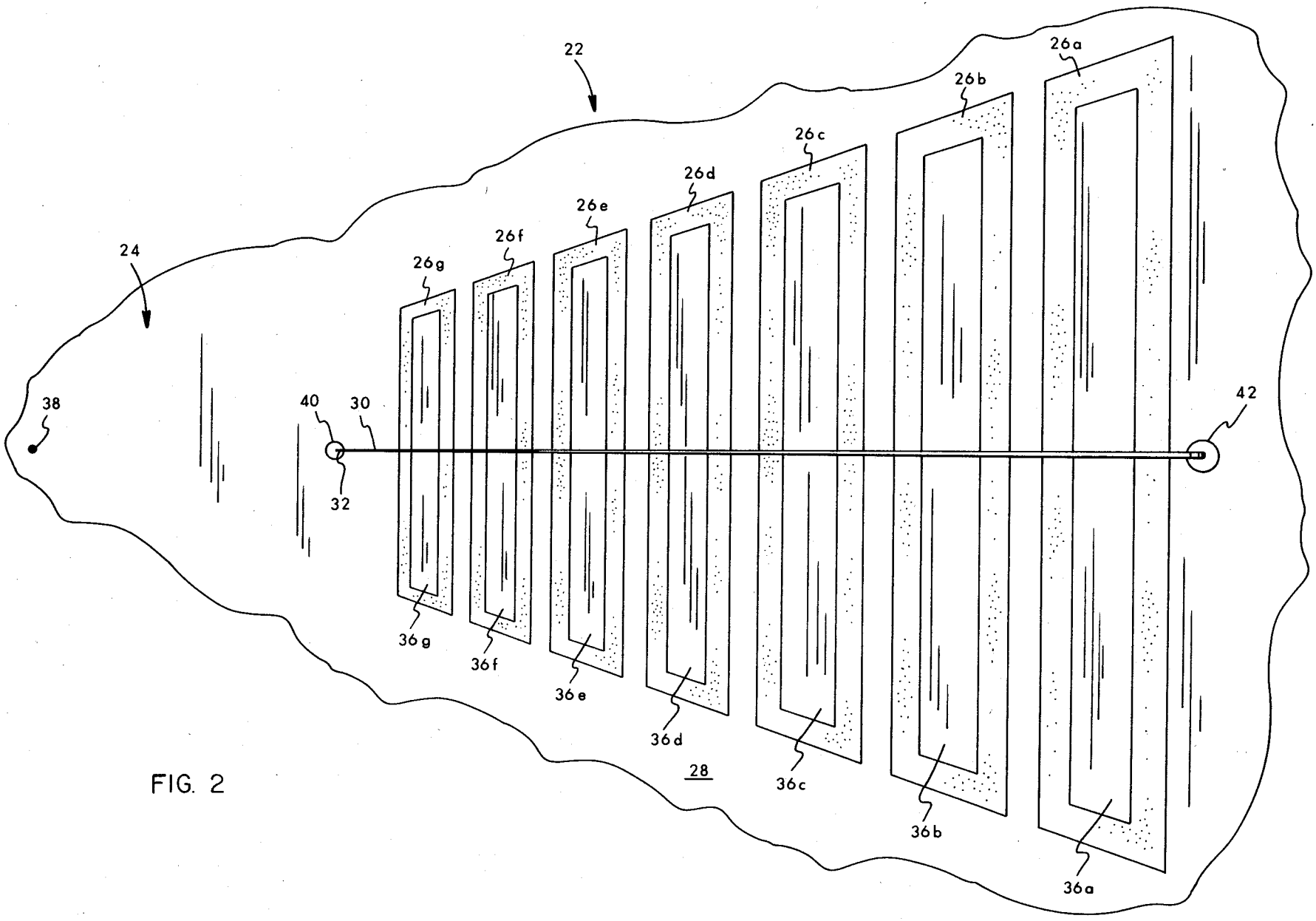
FIG. 2 is a plan view of a single log-periodic subarray employed in the array of FIG. 1.

A plan view of subarray 22 is given in FIG. 2, which shows the relative dimensions of the various slots 26. The ground plane 28 in the illustrated embodiment is made of a layer of copper on a fiberglass substrate. The slots 26 are made by etching away the copper to leave fiberglass in the slots. In the illustrated embodiment, copper is etched only from parts of the slots 26*a–g*; trapezoidal plates 36*a–g* are left in the centers of the slots 26*a–g*. These trapezoidal plates reduce the bandwidths of the slots. They also reduce diffraction effects.

The slot geometry is best seen in FIG. 2. FIG. 2 depicts the vertex 38 of the log-periodic subarray. The vertex is typically located at or near the center of the circular array. The wire 30 that serves as the traveling-wave element extends along a central longitudinal axis of the subarray, terminating at the inner end of the subarray with its left end 32 extending down through an opening 40 in the ground plane 28 to feed equipment for processing the received signals. The other end of the wire 30 terminates at the outer end of the subarray in a terminating resistor 42 that matches the characteristic impedance of the transmission line consisting of wire 30 and ground plane 28. This minimizes reflections from that end of the transmission line.

The geometry of the subarray depicted in FIG. 2 is called log-periodic because the slots occur, not at every point where the distance from the vertex 38 has increased by a certain amount over the distance from the last slot, but at every point where the logarithm of the distance from the vertex has increased by a certain amount. The dimensions throughout the subarray are proportional to distance from the vertex 38. Not only the dimensions of the slots but also their separations from each other are proportional to the distance from the vertex 38. Therefore, any two adjacent slots have dimensions that bear the same ratio to each other as do the dimensions of any other two adjacent slots. The importance of this factor will be discussed below.

FIG. 3 shows cavity-defining copper boxes 34*a–g* associated with the slots 26*a–g*. The walls of these boxes 34*a–g* extend through the fiberglass and are connected to the copper surface of the ground plane 28. The boxes 34*a–g* have the same size relationships to each other as their associated slots do. In particular, the depths—i.e., the distances from the ground plane to the bottoms of the cavities—have the same log-periodic progression as do the dimensions of the slots 26.

In operation, a signal is launched from the inner end 32 of the wire 30 and travels along the transmission line formed by the wire 30 and the ground plane 28. If the frequency of the signal happens to be the center frequency of the subarray 22, the first two slots 26*f* and 26*g* are small enough, and because of their trapezoidal plates 36*f* and 36*g* have narrow enough bandwidths, that their effect is negligible in launching radiation. The signal propagates over them as though the ground plane were continuous. When the signal reaches the third slot 26*e*, a significant fraction of its power is radiated by the slot because the length of slot 26*e* is near a half wavelength at that frequency. The greatest fraction of the signal power is radiated by slot 26*d*, whose length is exactly a half wavelength, and a lesser fraction radiates from slot 26*c*. The radiation from slots 26*a* and 26*b* is negligible because most of the power has already been radiated away by slots 26*c–e*.

The sizes of the trapezoidal plates are picked by experiment to achieve desirable slot bandwidths; it is beneficial for the bandwidths to be narrowed by the presence of the plates 36, but the bands of the slots must be wide enough that each frequency within the band of the array is significantly radiated by more than one slot; it is the summation of the radiation from different slots that results in directivity.

With the sizes of the trapezoidal plates 36*a–g* selected, it is primarily the depths of the cavities that determine the phase relationship between the radiation emanating from a given slot and the signal propagating along the transmission line comprising the ground plane 28 and the wire 30. The relative phases in turn determine the antenna pattern of the subarray. As was mentioned above, the pattern that results from the subarray is, according to the present invention, one in which the radiation propagating in the direction generally to the right in FIG. 2—i.e., toward the outer end—is greater than that propagating toward the inner end.

The log-periodic structure results in relatively frequency-independent operation throughout a wide range of frequencies. This can be appreciated by a review of the operation just described. It was mentioned above that, for a frequency in the center of the band of subarray 22—i.e., for the resonant frequency of slot 26*d*—negligible radiation occurred at slots 26*a, b, f,* and *g;* their effects could be ignored in comparison with those of slots 26*c, d,* and *e*. If, instead, a signal at the resonant frequency of slot 26*c* were to be launched, it can be appreciated by inspecting dimensional relationships that the contributions of all the slots except slots 26*b, c,* and *d* could be ignored. Furthermore, since the relationships of the dimensions of slots 26*b, c,* and *d* to each other are the same as the relationships among slots 26*c, d,* and *e,* and because these relationships bear the same relationship to the resonant wavelength of slot 26*c* as do the dimensions of slots 26*c, d,* and *e* to the resonant wavelength of slot 26*d,* the response of subarray 22 to the resonant frequency of slot 26*c* is the same as its response to the resonant frequency of slot 26*d*. Subarray 22 similarly has the same response to the resonant frequencies of slots 26*b–f*. Furthermore, it has been found that log-periodic arrays respond similarly to frequencies between resonant frequencies of the various elements, so the log-periodic subarray has a response that is substantially independent of frequency throughout a very wide frequency range.

Figure 4:
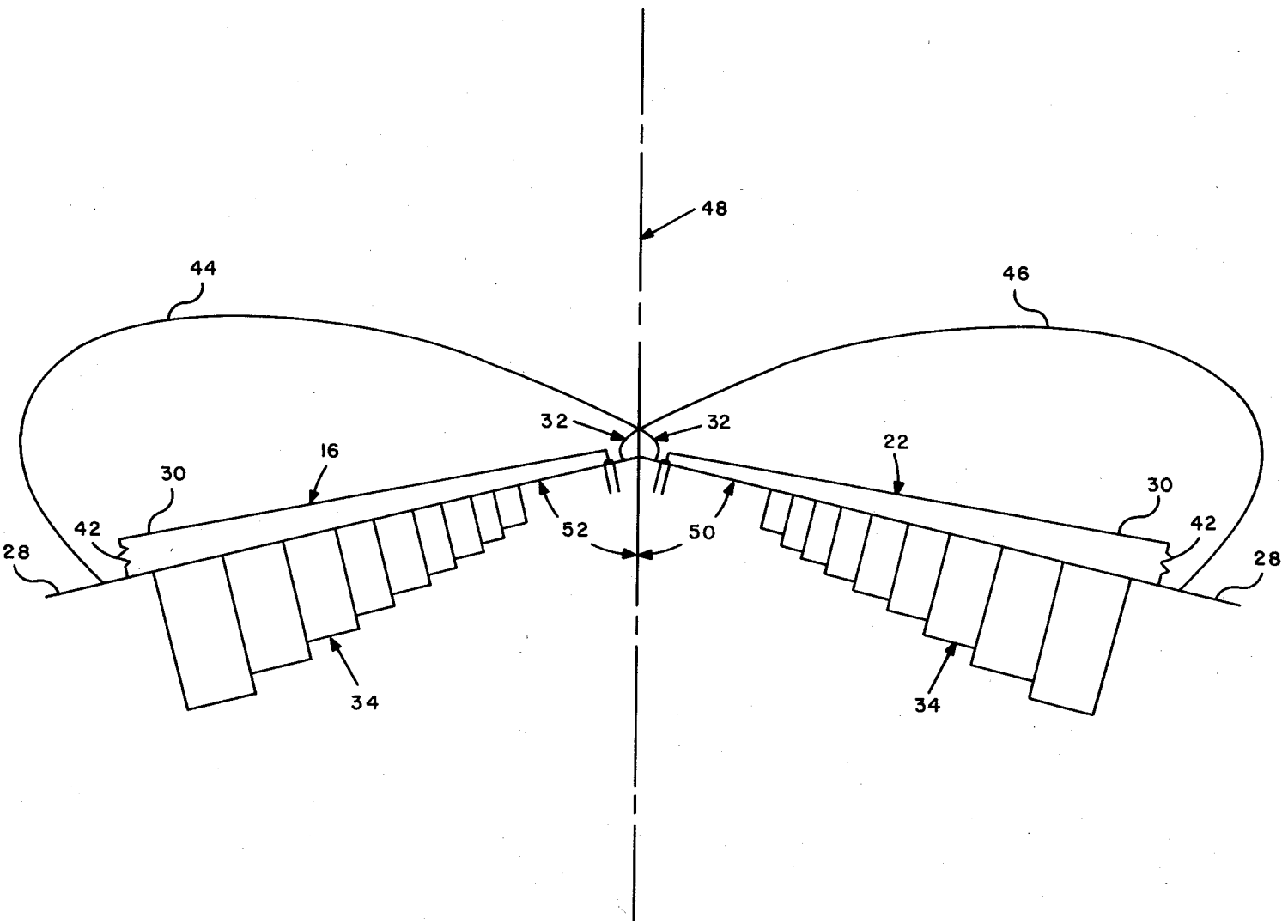
FIG. 4 is a diagrammatic representation of two opposed subarrays together with their antenna patterns.

The importance of launching in a forward-wave mode can be appreciated by reference to FIG. 4. FIG. 4 is a diagrammatic representation of two opposed subarrays 16 and 22 showing the general shapes of their radiation patterns. To avoid complicating the diagram, the radiation patterns are cut off at the ground planes 28, but those skilled in the art will recognize that, since the ground planes are not infinite in extent, the patterns will actually have non-zero values below the ground planes. These patterns 44 and 46 show that the maximum of the radiation pattern for a given subarray is directed generally forward—i.e., away from the center 24 of the composite array—and elevated slightly from the ground plane of the subarray. The ground planes of the subarrays 16 and 22 are tilted from a vertical array axis 48 so that angles 50 and 52—i.e., the angles formed by the ground planes of subarrays 16 and 22, respectively, and including the cavity-defining boxes of those arrays—are acute. As a consequence, the maxima of the antenna patterns for all of the subarrays can be directed substantially toward the horizon. This is the preferred direction because most radiation sources of interest are usually within a few degrees of the horizon in elevation.

The importance of choosing the depths of the cavities so that radiation predominates in the forward-wave mode can be appreciated by noting that there is little overlap between the patterns of the two opposed subarrays depicted in FIG. 4. That is, for elevations near the horizon, the magnitude of the pattern from array 16 is negligible compared with that from array 22 for directions to the right in FIG. 4, while the reverse is true for directions to the left in FIG. 4. Ordinarily, log-periodic arrays radiate in the backward-wave mode. If the array of log-periodic subarrays illustrated in the drawings employed log-periodic subarrays that radiate in the backward-wave mode, however, there would be significant overlaps in their radiation patterns. As a consequence, direction-finding errors would result. In contrast, no substantial overlap occurs with the system of the present invention, and significant improvement in direction-finding capability is afforded.

Those skilled in the art will recognize that the teachings of the present invention are applicable to systems that differ somewhat from the specific arrangement illustrated in the drawings. In particular, although a circular array of elements is disclosed, the teachings of the present invention are not limited to circular arrays; they are applicable to arrays of less than 360° of coverage in which overlap would occur between at least two subarrays if the conventional backward-wave operation were employed. Additionally, although the antenna array is shown with separate cavities for the corresponding slots in each of the subarrays, a common annular cavity with the proper depth could be used for all slots of the same size; there is no need to provide walls to segregate same-sized slots. Further variations will be apparent to those skilled in the art in light of the foregoing disclosure.

I claim:

1. An antenna array having a central feed region and comprising a plurality of antenna subarrays having longitudinal axes thereof extending outward in different directions from the central feed region, each antenna subarray comprising:

A. a ground-plane conductor having a substantially log-periodic arrangement of slots therein arrayed along the axis of that subarray and thereby defining low-frequency and high-frequency ends of the subarray, the high-frequency end being disposed near the central feed region, the low-frequency end being remote from the central feed region;

B. a traveling-wave element extending along the subarray on one side of the ground-plane conductor between its high-frequency and low-frequency ends for cooperation with the ground-plane conductor to support therewith propagation of electromagnetic waves in a forward direction along the subarray, the end of the traveling-wave element at the high-frequency end of the subarray being adapted for coupling to a transmitter or receiver; and C. cavity-defining conductor means associated with each slot and defining a cavity disposed on the other side of the ground-plane conductor and opening at its associated slot, the depths of the cavities being such as to give the subarray a sensitivity to electromagnetic radiation received from the direction of the high-frequency end of the subarray that is lower than its sensitivity to radiation received from the direction of the low-frequency end of the subarray.

2. An antenna array as defined in claim 1 wherein the ground-plane conductor includes an interior plate in each slot to reduce the diffraction effects of the slots.

3. An antenna array as defined in claim 2 wherein the axes of the subarrays are disposed substantially equiangularly about an array axis extending through the central feed region.

4. An antenna array as defined in claim 3 wherein:

A. the axis of each subarray defines with the array axis an acute angle that includes the cavity-defining conductor means of that subarray therein; and B. the maximum of the antenna pattern of each subarray is elevated from its ground-plane conductor.

5. An antenna array as defined in claim 2 wherein:

A. the axis of each subarray defines, with an array axis extending through the central feed region, an acute angle that includes the cavity-defining conductor means of that subarray therein; and B. the maximum of the antenna pattern of each subarray is elevated from its ground-plane conductor.

6. An antenna array as defined in claim 1 wherein the axes of the subarrays are disposed substantially equiangularly about an array axis extending through the central feed region.

7. An antenna array as defined in claim 6 wherein:

A. the axis of each subarray defines with the array axis an acute angle that includes the cavity-defining means of that subarray therein; and B. the maximum of the antenna pattern of each subarray is elevated from its ground-plane conductor.

8. An antenna array as defined in claim 1 wherein:

A. the axis of each subarray defines, with an array axis extending through the central feed region, an acute angle that includes the cavity-defining means of that subarray therein; and B. the maximum of the antenna pattern of each subarray is elevated from its ground-plane conductor.

* * * * *